US007062888B2

(12) United States Patent
Alesi

(10) Patent No.: US 7,062,888 B2
(45) Date of Patent: Jun. 20, 2006

(54) VAPOR AND TERMITE BARRIER AND METHOD FOR CONCRETE SLAB CONSTRUCTION

(75) Inventor: Roland Paul Alesi, Winter Park, FL (US)

(73) Assignee: Lawrence M. Rich, Lady Lake, FL (US)

( * ) Notice: Subject to any disclaimer, the term of this patent is extended or adjusted under 35 U.S.C. 154(b) by 278 days.

(21) Appl. No.: 10/446,544

(22) Filed: May 27, 2003

(65) Prior Publication Data

US 2004/0237459 A1 Dec. 2, 2004

(51) Int. Cl.
*E04B 1/00* (2006.01)

(52) U.S. Cl. ..... 52/741.4; 52/741.41; 52/741.3

(58) Field of Classification Search ..... 52/741.3, 52/741.4, 101, 220.1, 506.04, 515, 517, 741.1, 52/741.41, 745.05, 745.06
See application file for complete search history.

(56) References Cited

U.S. PATENT DOCUMENTS

| | | | | |
|---|---|---|---|---|
| 3,822,226 | A * | 7/1974 | Taft et al. | 525/127 |
| 4,190,686 | A * | 2/1980 | Muis | 427/317 |
| 4,297,450 | A | 10/1981 | Sato et al. | |
| 4,329,179 | A * | 5/1982 | Kutta | 588/252 |
| 4,518,736 | A | 5/1985 | Jahn | |
| 5,116,416 | A | 5/1992 | Knox et al. | |
| 5,369,130 | A * | 11/1994 | Numata | 514/772.3 |
| 5,415,612 | A * | 5/1995 | Carlson et al. | 492/56 |
| 5,417,017 | A * | 5/1995 | Toutountzis | 52/101 |
| 5,492,550 | A * | 2/1996 | Krishnan et al. | 51/298 |
| 5,870,865 | A * | 2/1999 | Wesolowski et al. | 52/169.5 |
| 5,919,851 | A * | 7/1999 | Yamaguchi et al. | 524/268 |
| 5,944,444 | A * | 8/1999 | Motz et al. | 405/37 |
| 6,167,668 | B1 * | 1/2001 | Fine et al. | 52/403.1 |
| RE37,133 | E | 4/2001 | Maynard | |
| 6,423,251 | B1 | 7/2002 | Blount | |
| 6,454,968 | B1 | 9/2002 | Blount | |
| 6,458,423 | B1 * | 10/2002 | Goodson | 427/403 |
| 6,486,343 | B1 | 11/2002 | Lieb et al. | |
| 6,544,596 | B1 * | 4/2003 | Clemens et al. | 427/407.1 |
| 6,783,799 | B1 * | 8/2004 | Goodson | 427/140 |
| 6,790,526 | B1 * | 9/2004 | Vargo et al. | 428/343 |
| 6,832,429 | B1 * | 12/2004 | Boyes et al. | 29/458 |
| 6,849,338 | B1 * | 2/2005 | Clemens et al. | 428/413 |

* cited by examiner

*Primary Examiner*—Jeanette E. Chapman
(74) *Attorney, Agent, or Firm*—adamsPATENT, PA; Robert W. Adams

(57) ABSTRACT

A vapor and termite barrier and method for use in concrete slab construction includes applying an elastomeric-seal fluid in a liquid state that cures into an elastomeric seal of all ground surface, reinforcement, conduits and concrete on a slab area. A method for applying the elastomeric-seal fluid is preferably spraying, but can include pouring, hosing and dumping. The elastomeric-seal fluid can include a mixture of germicide grade of chemical, such as boron, and a conventional product that is preferably white and has a consistency that is produced commercially for tops of house trailers and motor homes. Preventing runoff of the elastomeric-seal fluid before it cures into the elastomeric seal can be provided by a preparation step of eliminating excessive ground porosity and providing slab-area walls to a height necessary to contain the elastomeric-seal fluid at a rate that it is applied before it cures. Depth of the elastomeric-seal fluid can be ten to twenty mills, depending on consistency of the product. A highest preferred consistency of the product mixed with about one-fourth boron can be applied for a depth of about ten to twenty mills. Pouring concrete after applying the elastomeric-seal fluid and allowing it to cure for two-to-four hours, depending on weather and on product consistency, then can proceed more rapidly with less risk of damage to its protective barrier than for pouring concrete onto conventional plastic material.

10 Claims, No Drawings

VAPOR AND TERMITE BARRIER AND METHOD FOR CONCRETE SLAB CONSTRUCTION

BACKGROUND OF THE INVENTION

This invention relates to construction of concrete floors of dwellings with barriers that prevent intrusion of termites, toxic gas and corrosive vapors.

Concrete slabs for floors of dwellings allow intrusion of termites, moisture, toxic gasses and corrosive gases unless underlaid with a protective barrier. The laws and codes of most states in the United States, particularly Southern States, require that soil be treated for infestation by spraying with pesticide or other toxic chemicals prior to the pouring of a concrete slab. To protect inhabitants against disease and property damage from such intrusions, an increasing number state building codes in America require that a slab area and any conduits protruding from it be covered with about a six one thousandth (6/1000) of an inch thick of plastic material known as Visqueen® before laying reinforcement steel, such as rebar and welded wire mesh, and pouring concrete. This requires much labor for cutting the plastic material to size and leak-proof taping the conduits to the plastic material. It also requires careful laying of reinforcement pouring of the concrete to prevent rupture of the material or the leak-proof taping and risk of voiding any warranty on the pesticide treatment. Furthermore, the reinforcement steel and wire mesh is exposed to corrosive elements which can result in weakening of the concrete slab and later structural problems. Although plastic coated steel wire mesh has been used in many cases in an attempt to prevent corrosion, it cost as much as sixty percent (60%) more than uncoated reinforced steel.

Labor and material for the inadequate prior-art procedure are a substantial cost burden. Prior to this invention, however, it has been the best and only known method for accomplishing building-code objectives. At best, however, a reliable seal is rarely achieved.

Thus, a need exists for a new and better barrier and method for use in concrete slab construction which eliminates these problems.

Examples of different prior art for treating wood and other organic substances, but not for treating ground; reinforcement metal and conduits under concrete slabs as taught by this invention include the following.

| Patent No. (U.S. unless stated otherwise) | Inventor | Issue Date |
|---|---|---|
| 6,423,251 | Blount | Jul. 23, 2002 |
| RE37,133 E | Maynard | Apr. 10, 2001 |
| 4,190,686 | Muis | Feb. 26, 1980 |
| 6,454,968 | Blount | Sep. 24, 2002 |
| 6,486,343 | Lieb, et al. | Nov. 26, 2002 |
| 4,297,450 | Sato | Oct. 27, 1981 |
| 4,518,736 | Jahn | May 21, 1985 |
| 5,116,416 | Knox, et al. | May 26, 1992 |

SUMMARY OF THE INVENTION

Objects of patentable novelty and utility taught by this invention are to provide a vapor and termite barrier and method which:

saves labor costs of cutting, fitting and laying plastic material onto slab areas and reinforcement material before pouring concrete for concrete slabs;

saves labor costs of attempting to seal-proof-tape water pipes and electrical conduits to the plastic material;

provides a reliable barrier to intrusion of termites, corrosive air and toxic gases;

has building-life endurance;

can be spot-applied for mending ruptures resulting from building repairs and alterations;

can be applied quickly and easily; and is less expensive than code-mandated plastic material.

This invention accomplishes these and other objectives by applying an elastomeric-seal fluid in a liquid state that cures into an elastomeric seal of all ground surface, reinforcement, conduits and concrete. A method for applying the elastomeric-seal fluid is preferably spraying, but can include pouring, hosing and dumping. The elastomeric-seal fluid can include a mixture of about one-fifth-to-one-third powdered boron and a conventional product that is preferably white and has a consistency that is produced commercially for tops of house trailers and motor homes. The ground surface may first be prepared by spraying it with water, which limits absorption of the elastomeric-seal fluid and solidifies the fluid almost immediately. The latter wetting of the ground surface is especially desirable when there exists excessive ground surface porosity and thereby limiting absorption of the fluid eliminates possible environmental damage. Depth of the elastomeric-seal fluid can be 10 to 20 one thousandths (mills) of an inch, depending on consistency of the product. A preferred consistency of product mixed with about one-fourth boron can be applied for a depth of about 10 to 20 mills. Pouring concrete after applying the elastomeric-seal fluid and allowing it to cure for two-to-four hours, depending on weather and on product consistency, then can proceed more rapidly with less risk of damage to its protective barrier than for pouring concrete onto conventional plastic material.

The above and other objects, features and advantages of the present invention should become even more readily apparent to those skilled in the art upon a reading of the following detailed description.

DESCRIPTION OF PREFERRED EMBODIMENT

A method for providing a barrier for protection against intrusion of termites, moisture, toxic gas and corrosive vapors through a concrete slab in a slab area for a dwelling includes the steps of placing all of any intended concrete-reinforcement material on the slab area; positioning all of any conduits and pipes for extension through an intended concrete slab from under a surface of the slab area; applying a predetermined elastomeric-seal fluid to a depth on the slab area that is predetermined for a particular elastomeric-seal fluid; assuring that the elastomeric-seal fluid contacts exterior surfaces of the conduits and pipes and of any other items that may protrude through the intended concrete slab with a continuity of the elastomeric-seal fluid that also covers the slab area; allowing the elastomeric-seal fluid to cure predeterminedly; and pouring concrete for the concrete slab without rupturing continuity of the elastomeric product in contact with the exterior surfaces of any projections from the slab area and the elastomeric-seal fluid that is applied onto the slab area.

If the slab area is excessively porous, a slab-preparation step can be included for preparing the slab area for preventing runoff and absorbance of the elastomeric-seal fluid at a rate faster than the elastomeric-seal fluid is applied for its fluid consistency and for weather conditions.

If the slab area is excessively porous in proportion to viscosity of an intended elastomeric fluid, an additional step is provided for decreasing porosity of the slab area with suitably non-porous surfacing prior to placing intended concrete-reinforcement material on the slab area.

In the event that the elastomeric seal is ruptured by whatever cause at whatever time after pouring the concrete slab, it can be mended by an additional step of applying sufficient additional elastomeric-seal fluid to the portion of the elastomeric seal that is ruptured.

The elastomeric-seal fluid comprises a mixture of about one-fifth-to-one-third powdered germicide grade of boron with a remaining amount of a conventional product that is constituted to cure into an elastomeric seal containing a germicide grade of boron.

The conventional product is preferably but not necessarily white paint.

The conventional product can include a consistency that is produced commercially for tops of house trailers and motor homes.

A highly preferred consistency of the elastomeric seal fluid is comprised of product mixed with about one-fourth boron that is applied for a depth of about 10 to 20 mills.

The elastomeric-seal fluid can include a consistency that cures into the elastomeric seal within preferably about two-to-four hours after being applied.

A new and useful vapor and termite barrier and method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A method comprising the following steps for providing a barrier for protection against intrusion of termites, moisture, toxic gas and corrosive vapors through a concrete stab in a slab area for a dwelling wherein the site has been prepared by positioning the conduits, pipes, other items for extension through an intended concrete slab from under a surface of the slab area:

applying a predetermined elastomeric-seal fluid to a depth on the slab area that is predetermined for the elastomeric-seal fluid;

causing the elastomeric-seal fluid to contact exterior surfaces of any wire conduits, pipes, other items that may protrude through the intended concrete slab and any reinforcement material with a continuity of the elastomeric-seal fluid that covers the slab area; and, allowing the elastomeric-seal fluid to cure predeterminedly into an elastomeric seal to the wire conduits, pipes other items that may protrude through the intended concrete slab end the reinforcement material;

wherein said method is in preparation of applying concrete for the concrete slab.

2. The method of claim 1 and further comprising; a slab-preparation step of preparing the slab area for preventing absorbance of the elastomeric-seal fluid into a ground surface by spraying the ground surface with water prior to applying the elastomeric seal fluid.

3. The method of claim 1 wherein the slab area is excessively porous for a viscosity of an intended rate of applying an intended elastomeric-seal fluid and comprising a slab-preparation step of: decreasing porosity of the slab area with suitably non-porous surfacing prior to placing intended concrete-reinforcement material on the slab area.

4. The method of claim 1 wherein a portion of the elastomeric seal is ruptured by whatever cause at whatever time after pouring the concrete slab and comprising an additional step of: applying sufficient additional elastomeric-seal fluid to the portion of the elastomeric seal that is ruptured.

5. A method comprising the following steps for providing a barrier for protection against intrusion of termites, moisture, toxic gas and corrosive vapors through a concrete slab in a slab area for a dwelling wherein the site has been prepared by positioning the conduits, pipes, other items for extension through an intended concrete slab from under a surface of the slab area:

applying a predetermined elastomeric-seal fluid to a depth on the slab area that is predetermined for the elastomeric-seal fluid, wherein said elastomeric-seal fluid comprises a mixture of germicide grade of a chemical with a remaining amount of a conventional product that is constituted to cure into an elastomeric seal containing the germicide grade of chemical;

causing the elastomeric-seal fluid to contact exterior surfaces of any wire conduits, pipes, other items that may protrude through the intended concrete slab and any reinforcement material with a continuity of the elastomeric-seal fluid that covers the slab area; and, allowing the elastomeric-seal fluid to cure predeterminedly into an elastomeric seal to the wire conduits, pipes other items that may protrude through the intended concrete slab and the reinforcement material;

wherein said method is in preparation of applying concrete for the concrete slab.

6. The method of claim 5 wherein the chemical is selected from a group of chemicals including boron.

7. The method of claim 5 wherein: the conventional product includes white paint.

8. The method of claim 5 wherein: the conventional product includes a consistency that is produced commercially for tops of house trailers and motor homes.

9. The method of claim 6 wherein: a highest preferred consistency of the product mixed with about one-fourth boron is applied to said slab area for a depth of about ten to twenty one-thousands of an inch.

10. The method of claim 5 wherein: the elastomeric-seal fluid includes an elastomeric-seal fluid that cures into the elastomeric seal within about two-to-four hours after being applied.

* * * * *